US006979786B2

(12) United States Patent
Aukland et al.

(10) Patent No.: US 6,979,786 B2
(45) Date of Patent: Dec. 27, 2005

(54) CONTACT STRUCTURES FOR SLIDING SWITCHES

(75) Inventors: Neil R Aukland, Sterling Heights, MI (US); Thomas J Schoepf, Rochester Hills, MI (US); George Albert Drew, Warren, OH (US); Gerd Rudolph, Aspisheim (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/803,764

(22) Filed: Mar. 18, 2004

(65) Prior Publication Data

US 2005/0205396 A1 Sep. 22, 2005

(51) Int. Cl.[7] ..... H01H 15/00
(52) U.S. Cl. ..... 200/16 A; 200/16 R
(58) Field of Search ..... 200/16 A, 531, 200/547–551, 16 R–16 D, 541; 218/6

(56) References Cited

U.S. PATENT DOCUMENTS

| | | | | |
|---|---|---|---|---|
| 4,506,119 | A * | 3/1985 | Tanabe | 200/16 C |
| 4,825,020 | A * | 4/1989 | Rao et al. | 200/16 D |
| 5,357,069 | A | 10/1994 | Nishio et al. | |
| 5,365,028 | A * | 11/1994 | Takano | 200/547 |
| 5,672,854 | A * | 9/1997 | Nishio | 200/16 R |
| 5,898,142 | A * | 4/1999 | Ohtaki et al. | 200/16 C |
| 6,072,138 | A | 6/2000 | Sato | |
| 6,488,549 | B1 | 12/2002 | Weller et al. | |
| 6,831,239 | B2 * | 12/2004 | Van Den Akker et al. | 200/16 A |

* cited by examiner

*Primary Examiner*—Elvin G. Enad
*Assistant Examiner*—Lisa Klaus
(74) *Attorney, Agent, or Firm*—David P. Wood

(57) ABSTRACT

A contact structure for a sliding switch includes a conductive stationary contact disposed on a base and a conductive movable contact for electrically contacting the stationary contact. The movable contact is movable along a path between a non-contact position and a make-contact position with respect to the stationary contact, and at least one of the contacts has a protruding portion that provides an electrical interface for discharge of arcing as the movable contact breaks from the stationary contact. As a result, the invention prevents or substantially reduces degradation in switch performance which might otherwise be caused by debris accumulation associated with arcing.

9 Claims, 7 Drawing Sheets

CONTACT STRUCTURES FOR SLIDING SWITCHES

TECHNICAL FIELD

The present invention relates generally to the structure of contacts of a sliding switch and, in particular, to the structure and configuration of stationary and movable contacts.

BACKGROUND OF THE INVENTION

There is a growing demand for sliding switches that use printed circuit boards, wire frames, and the like as stationary contacts. Such switches are used in vehicles (e.g., to control lights, turn signals, etc.), in household devices (e.g., as program switches for washers and dryers, etc.), and many other applications.

A conventional arrangement and structure of contacts of a sliding step switch is shown in FIGS. 12–14. The arrangement depicts a three function configuration 510 for a sliding switch. A circuit board substrate 512 is formed of a synthetic resin made of an insulating material. A first conductive stationary contact pad 514 connected to a positive terminal of a power source is disposed on substrate 512. Second, third, and fourth conductive stationary contact pads 516, 518, 520 connected to a negative terminal of a power source through an electrical load via a ground connection are disposed on substrate 512. An insulating material 522 such as a solder mask is disposed between contact pads 514, 516, 518, 520.

A movable contact assembly 524 is mounted to an unillustrated holder which permits movement in the directions indicated by arrows A and B. Movable contact 524 includes first and second cylindrically shaped movable conductive contact heads 526, 528, mounted to respective conductive contact springs 530, 532. Contact springs 530, 532 are connected together by a conductive metal strip 534.

As shown on FIG. 12, movable contact assembly 524 is in a first steady state position enabling current to flow from first contact pad 514 through movable contact 524 into second contact pad 516 to activate the function controlled by second contact pad 516. As movable contact assembly 524 moves along a path in parallel with the direction of arrow B movable contact heads 526, 528 moves to other positions where various functions are activated or deactivated. Likewise, movable contact assembly 524 can also move along a path in parallel with arrow A.

Electrical contact is made between a cylindrically shaped movable contact head and a flat stationary contact pad by pressing the contact head onto the stationary contact pad creating a line of electrical contact points. Upon operation of the switch, contact is broken by movement of the movable contact head past the edge of the stationary contact pad, a line of electrical contact points being maintained until just before breaking the contact.

Under specific voltage and current conditions, an arc is initiated at the last point of electrical contact as the electrical contacts are moved apart from each other. The current flowing through the gap between contacts generates heat, resulting in temperatures high enough to cause arc erosion; some of the nearby insulation may be burned away.

FIG. 13 illustrates an electrical schematic of the switch configuration shown on FIG. 12. FIG. 14 shows a sectional view of the switch configuration shown on FIG. 12.

FIG. 15 illustrates the area 546 on a conventional contact pad where arcing occurs. This area is known as an arcing zone. During the life of the switch, debris fields 548 including both conductive and insulating material build up on the stationary contact pads and insulating regions as a result of arc erosion.

Sliding movement of the contact head through the debris field also causes debris particles to be dragged into a main or steady state area of contact, known as a contacting zone 542, on the stationary contact pad 520 resulting in increased contact resistance when the contact head electrically contacts the contacting zone on the stationary contact pad during steady state use of the switch. The switch fails when debris causes the resistance between contacts to increase to a level whereby the contacts can no longer effectively complete a circuit or resistance becomes unacceptably high. FIG. 16 illustrates a graph showing voltage drop across contacts as a function of switching cycles of a conventional switch. In the illustrated example, voltage begins to increase and become unstable after about 25 arcing cycles.

During switch operation, debris particles are also dragged onto insulating material disposed between stationary contact pads as the contact head is moved from one contact pad to another. Debris on the insulation material reduces the dielectric strength of the insulation. The switch fails when the isolation resistance between the contact pads is reduced to a point where a circuit is established between contact pads. Lubrication of the contacts generally increases the rate at which debris is deposited onto the insulation.

As electrical performance requirements for sliding switches continue to increase, improvement in sliding switch performance is needed to satisfy increasingly stringent requirements.

SUMMARY OF THE INVENTION

The present invention provides contact structures for a sliding switch capable of extending the service life of the switch while maintaining voltage stability as compared with a conventional contact structure.

In accordance with a first aspect of the present invention, an improved contact structure is provided for a sliding switch having a stationary contact pad and a movable contact that is capable of directing accumulation of arcing debris away from a portion of a steady state contacting zone on the stationary contact pad. Consequently, a portion of the contacting area between stationary and movable contacts remains generally free of arcing erosion debris for an extended portion of the service life of the switch, thus extending the service life and improving voltage stability as compared to a conventional configuration.

In accordance with the first aspect of the present invention, a contact structure for a sliding switch includes a stationary contact pad and a movable contact which moves along a path extending between a non-contact position where the movable contact is electrically isolated from the stationary contact pad and a make-contact position where the movable contact maintains a primary electrical interface with the stationary contact pad, the stationary contact pad including a contacting zone that electrically makes contact with the movable contact when the movable contact is in the make-contact position, the stationary contact including an arcing zone that electrically breaks from or makes the movable contact when the movable contact moves from the make-contact position to the non-contact position and vice versa, the arcing zone providing an area where arcing occurs between the stationary contact and the movable contact, the stationary contact and the movable contact are shaped and configured such that when the contacting zone is projected in parallel with respect to the path onto the arcing zone, at least a portion of a projection of the contacting zone lies outside the arcing zone to provide a region within the contacting zone which is generally outside of an arcing erosion debris path created by the movable contact as it slides across the stationary contact.

In a preferred embodiment of a sliding switch including a movable contact and a flat stationary contact pad, a contact edge defined on the stationary contact pad such that the contact edge electrically contacts the movable contact as the movable contact moves between a non-contact position and a steady state contact position, the movable contact has a cylindrically shaped contact head and the flat stationary contact pad has a V-shaped contact edge configured to partially define a concave region on the stationary contact pad. Consequently, two arcing zones are provided and a substantially arc free region is provided in between. Thus a portion of a contacting zone projected along a path of movement of the movable contact head falls on the substantially arc free region. A portion of the contacting zone, therefore, lies generally outside of an arcing erosion debris path created by the movable contact as it slides across the stationary contact. Other contact configurations may be used so that at least a portion of a projection of the contacting zone lies outside the arcing zone to provide a region within the contacting zone which is generally outside of an arcing erosion debris path created by the movable contact as it slides across the stationary contact.

In accordance with a second aspect of the present invention, a contact configuration is provided which is capable of directing arcing toward the contact pad connected to the positive terminal of a power source and away from contact pads connected to a negative terminal. This configuration is advantageous because accumulation of conductive arcing debris between adjacent stationary contact pads is reduced compared with configurations known in the art. Thus, dielectric strength between adjacent contact pads is maintained over an extended portion of the service life of a switch.

Further in accordance with the second aspect of the present invention, a contact configuration for a sliding switch includes a first stationary contact pad connected to a positive terminal of a power source, a second stationary contact pad connected to a negative terminal, and a movable contact, an insulating region electrically isolating each of the contact pads, the movable contact is configured to be movable between a contact position where the movable contact electrically connects the first and second stationary contact pads and a non-contact position where movable contact is electrically isolated from the second stationary contact pad, the first stationary contact pad and movable contact being configured so that as the movable contact moves from the contact position to the non-contact position the movable contact breaks from second stationary contact pad before it breaks from the first stationary contact pad and as the movable contact moves from the non-contact position to the make contact position, the movable contact makes contact with the first stationary contact pad before it makes contact with the second stationary contact pad.

In accordance with a third aspect of the present invention, a contact configuration is provided which is capable of directing arcing to occur simultaneously at a contact pad connected to a negative terminal and a contact pad connected to a positive terminal. Consequently, arcing energy is split between each contact pad. This configuration results in a decreased formation of arcing erosion debris at the contact pad connected to the negative terminal as compared to the amount generated by configurations known in the prior art.

Further in accordance with the third aspect of the present invention, a contact configuration for a sliding switch includes a first stationary contact pad connected to a positive terminal of a power source, a second stationary contact pad connected to a negative terminal, and a movable contact, an insulating region electrically isolating each of the contact pads, the movable contact is configured to be movable between a contact position where the movable contact electrically connects the first and second stationary contact pads and a non-contact position where movable contact is electrically isolated from the second stationary contact pad, the first stationary contact pad and movable contact being configured so that as the movable contact moves from the contact position to the non-contact position the movable contact breaks from second stationary contact pad at the same time that it breaks from the first stationary contact pad and as the movable contact moves from the non-contact position to the make contact position, the movable contact makes contact with the first stationary contact pad at the same time that it makes contact with the second stationary contact pad.

These and other features and advantages of the present invention will become apparent from the following brief description of the drawings, detailed description, and appended drawings.

BRIEF DESCRIPTION OF THE DRAWINGS

The above-mentioned features of the present invention can be more clearly understood from the following detailed description considered in conjunction with the following drawings, in which like numerals represent like elements and in which.

DETAILED DESCRIPTION OF THE INVENTION

As discussed above, contact configurations in accordance with the present invention are capable of providing an increased number of switching cycles while providing a more stable resistance across contacts than achieved by known contact configurations.

Figure 1:
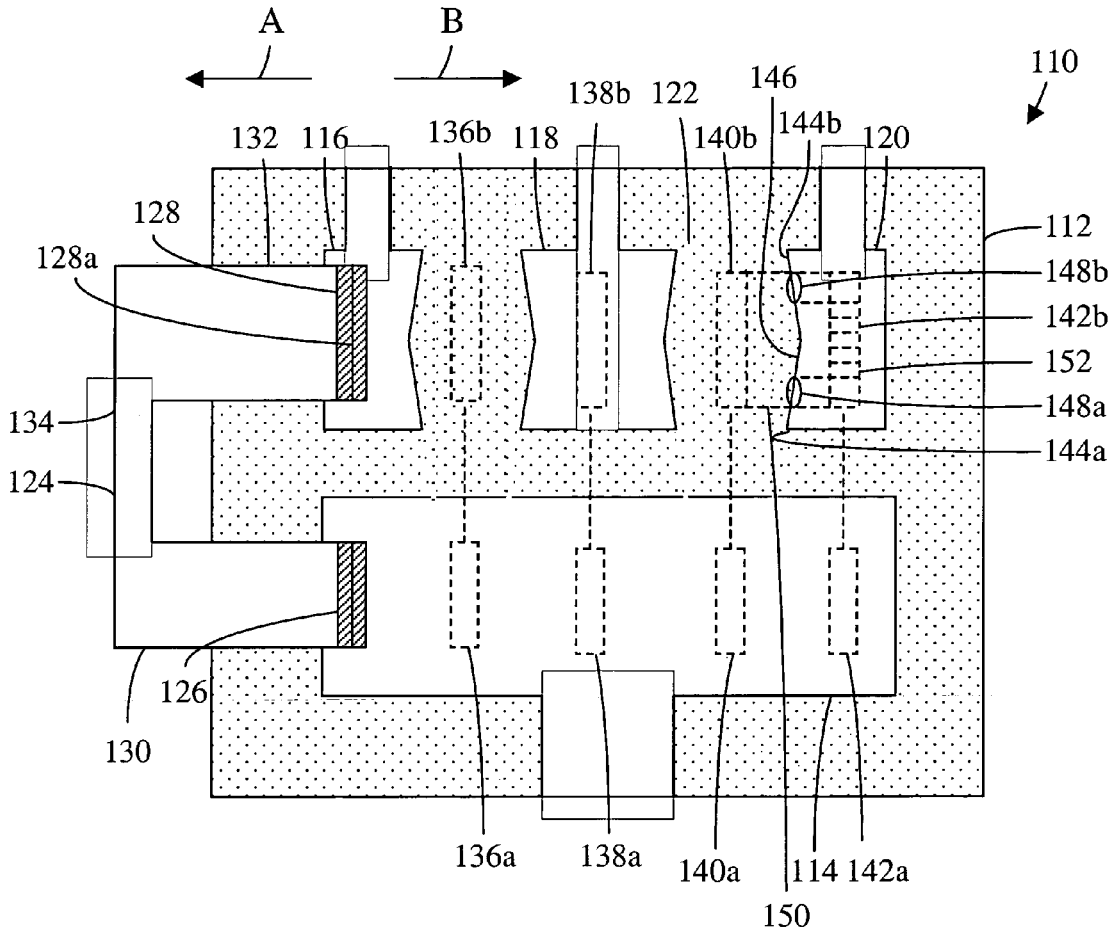
FIG. 1 is a plan view of a first exemplary embodiment of a contact structure in accordance with the present invention.
Figure 2:
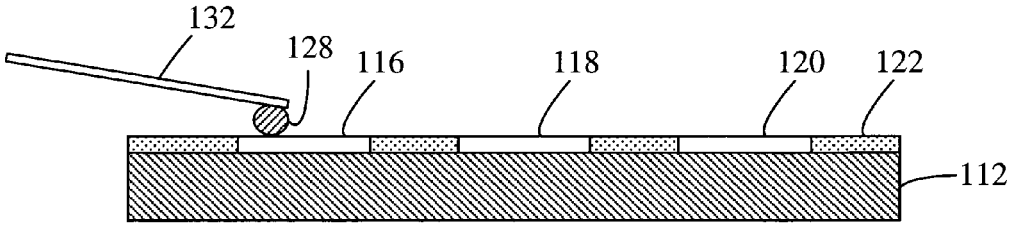
FIG. 2 is a sectional view of the contact structure shown on FIG. 2.

Referring to the figures, FIGS. 1–2 illustrate a first exemplary embodiment of a contact configuration 110 for a sliding switch.

A circuit board substrate 112 is formed of a synthetic resin made of an insulating material. A first conductive stationary contact pad 114 connected to a positive terminal of a power source is disposed on substrate 112. Second, third, and fourth conductive stationary contact pads 116, 118, 120 connected to a negative terminal of a power source via a ground connection are disposed on substrate 112. An insulating material 122 such as a solder mask is disposed between contact pads 114, 116, 118, 120.

A conductive movable contact assembly 124 is mounted to an unillustrated holder which permits movement in the directions indicated by arrows A and B. Movable contact assembly 124 includes first and second cylindrically shaped conductive movable contacts 126, 128, mounted to respective conductive contact springs 130, 132. Contact springs 130, 132 are connected together by a conductive metal strip 134. As shown on FIG. 1, second movable contact 128 maintains electrical contact with respective stationary contact pads 116, 118, 120 generally at a contact line 128*a* where the cylindrically shaped second movable contact 128 contacts a respective contact pad 116, 118, 120.

As shown on FIG. 1, movable contact assembly 124 is in a first steady state position enabling current to flow from first contact pad 114 through movable contact assembly 124 into second contact pad 116 to activate the function controlled by second contact pad 116. As movable contact assembly 124 moves along a path in parallel with the direction of arrow B movable contacts 126, 128 move to a second steady state position illustrated in phantom at 136*a*, 136*b*, respectively that represents a first OFF position. Movable contact assembly 124 can continue to move in the direction of arrow B to a third steady position illustrated by contacting zones shown in phantom at 138*a*, 138*b* where the function controlled by third contact pad 118 is activated, to a fourth steady position illustrated in phantom at 140*a*, 140*b* respectively, that represents a second OFF position, and to a fifth steady state position illustrated by contacting zones shown in phantom at 142*a*, 142*b* respectively, where the function controlled by fourth contact pad 120 is activated. Likewise, movable contact assembly 124 can move from fifth steady position illustrated by contacting zones shown in phantom at 142*a*, 142*b* respectively along a path in parallel with arrow A to other steady state positions.

As shown on FIG. 1, fourth contact pad 120 has first and second protruding portions 144*a*, 144*b* that provide an electrical interface for discharge of arcing as second movable contact 128 moves between fourth and fifth positions in a direction parallel with respect to arrows A and B thereby making contact with or breaking contact from fourth contact pad 120. Protruding portions 144*a*, 144*b* are each at least partially defined by a peripheral edge 146 that is in non-parallel relation with respect to contact line 128*a*. As shown on FIG. 1, first and second protruding portions 144*a*, 144*b* in combination form a "V" shape. The top of the "V" functioning as first and second arcing zones 148*a*, 148*b*, respectively, which provide an electrical interface for discharge of arcing.

As illustrated on FIG. 1, when contacting zone 142*b* is projected along movement path (indicated by arrows A and B) onto first and second arcing zones 148*a*, 148*b*, at least a portion of a projection 150 of contacting zone 142*b* lies outside arcing zones 148*a*, 148*b* thereby providing a region 152 within contacting zone 142*b* which is generally outside of an arcing erosion debris path (648*a*, 648*b* as shown on FIG. 5) created by second movable contact 128 as it slides across fourth contact pad 120.

Likewise, second and third contact pads 116, 118 have protruding portions that provide an electrical interface for discharge of arcing.

Figure 5:
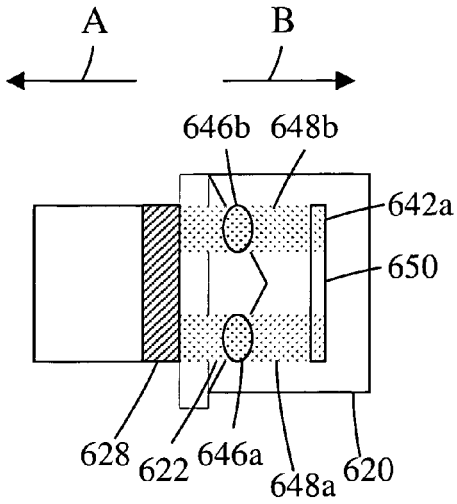
FIG. 5 is a plan view illustrating an aspect of the present invention.
Figure 6:
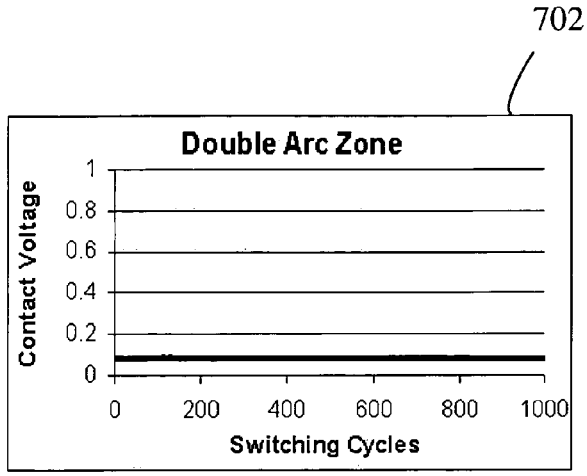
FIG. 6 is a graph depicting contact voltage between a movable contact head and stationary contact as a function of switching cycles for an exemplary embodiment of a contact configuration of the present invention.
Figure 16:
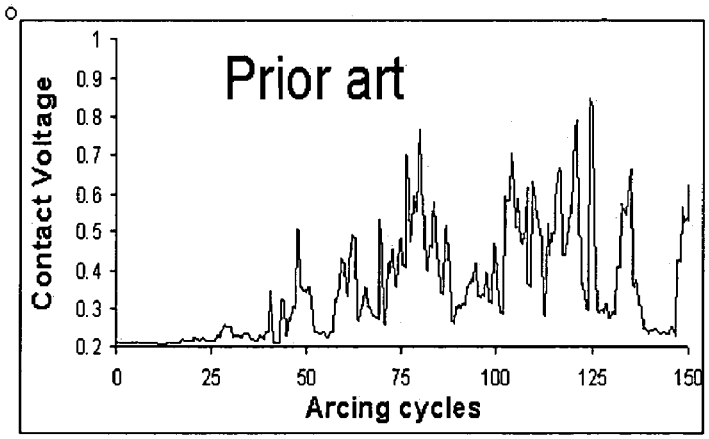
Fig. 16 Prior Art
FIG. 16 is a graph depicting an aspect of a prior art contact structure.

FIG. 5 shows a movable contact 628 and a stationary contact pad 620 similar to second movable contact 128 and fourth stationary contact pad 120 as shown on FIGS. 1 and 2. FIG. 5 illustrates two areas, known as arcing zones 646*a*, 646*b*, that provide an electrical interface where arcing occurs on stationary contact pad 620 as movable contact head 628 moves between fourth and fifth steady state positions 640*a*, 642*a* as depicted on FIG. 1. Arcing erosion debris fields including both conductive and insulating material that build up on stationary contact pad 620 and insulating material 622 during the service life of switch are generally shown at 648*a*, 648*b*. Debris fields 648*a*, 648*b* generally spread from arcing zones 646*a*, 646*b* in parallel with respect to a path of movement of contact head 628 in the direction of arrows A and B. Consequently, there is a portion 650 of contacting zone 642*a* that generally remains outside of arcing erosion debris fields 648*a*, 648*b* over an extended portion of the service life of switch. As a result, as shown on FIG. 6, contact voltage between movable contact 628 and stationary contact pad 620 remains low and stable over an extended portion of the service life of switch. This is a significant improvement over the performance, as shown by graph 702 on FIG. 16, of contact configurations of switches known in the prior art.

Figure 3:
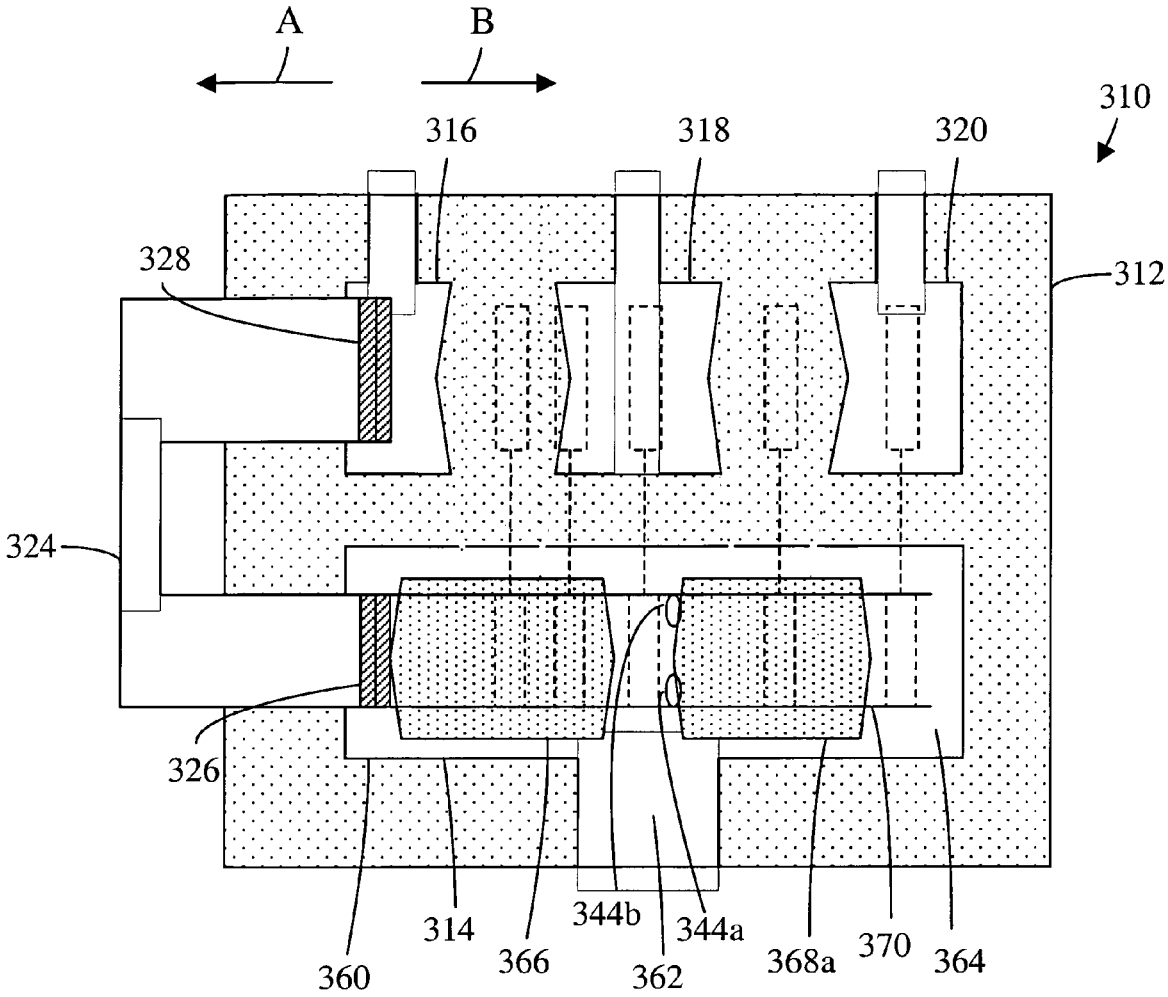
FIG. 3 is a plan view of a second exemplary embodiment of a contact structure in accordance with the present invention.

FIG. 3 illustrates a second contact arrangement 310 for a sliding switch. Second contact arrangement 310 is similar to arrangement 110 depicted in FIG. 1 in that it includes second, third, and fourth conductive stationary contact pads 316, 318, 320 connected to a negative terminal of a power source via a ground connection are disposed on substrate 312. Second contact arrangement 310 further includes a conductive movable contact assembly 324 including first and second cylindrically shaped conductive movable contacts 326, 328. Second contact arrangement 310 varies from first contact arrangement 110 in that a first stationary contact pad 314 which is connected to a positive terminal of a power source includes first, second, and third conductive pad portions 360, 362, 364 with a first insulating region 366 being disposed between first and second pad portions 360, 362 and a second insulation region 368 being disposed between second and third pad portions 362, 364.

Second contact arrangement 310 is configured such that as the switch moves from an ON position to an OFF position, first movable contact 326 breaks contact first from first stationary contact pad 314 before breaking from one of second, third, or fourth contact pads 316, 318, 320. Second contact arrangement 310 is also configured such that as the switch moves from an OFF position to an ON position, second movable contact 328 makes contact with one of second, third, or fourth contact pads 316, 318, 320 before first movable contact 326 makes contact with first stationary contact pad 314. Consequently, arcing occurs between first movable contact 326 and first stationary contact pad 314 and does not occur for a significant portion of the service life of switch between second movable contact 328 and second, third, and fourth stationary contacts pads 316, 318, 320. This is advantageous in that conductive arc debris does not form between second, third, and fourth stationary contact pads 316, 318, 320 that reduces the dielectric strength between adjacent pads or which could cause a conductive circuit to form between pads. Protruding portions 344*a*, 344*b* are illustrated on second portion 362 of first stationary contact pad 314. Arcing generally occurs at the protruding portions 344*a*, 344*b* generally within path 370.

Figure 4:
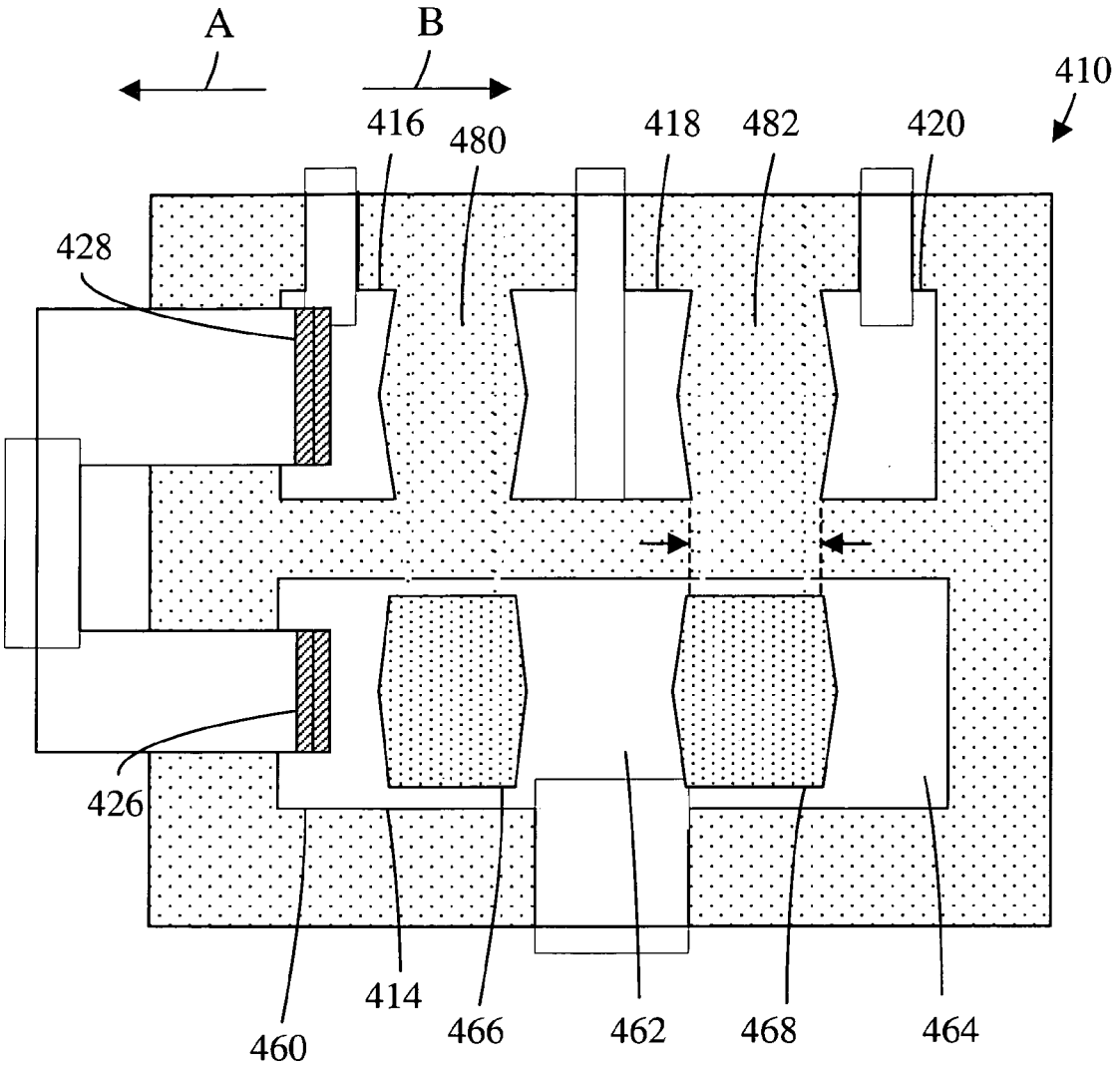
FIG. 4 is a plan view of a third exemplary embodiment of a contact structure in accordance with the present invention.

FIG. 4 illustrates a third contact arrangement 410 for a sliding switch. Third contact arrangement 410 is similar to arrangement 310 depicted in FIG. 3 and includes a first stationary contact power pad 414 which is connected to a positive terminal of a power source. First stationary contact power pad 414 includes first, second, and third conductive pad portions 460, 462, 464 with a first insulating region 466 being disposed between first and second pad portions 460, 462 and a second insulation region 468 being disposed between second and third pad portions 462, 464. A third insulating region 480 exists between first and second stationary contact pads 416, 418 and a fourth insulation arrangement 482 exists between second and third stationary contact pads 418, 420.

Third contact arrangement 410 is configured such that as the switch moves from an ON position to an OFF position, a first movable contact 426 breaks contact from first stationary contact pad 414 simultaneously with second movable contact 428 breaking contact with one of second, third, or fourth contact pads 416, 418, 420. Second contact arrangement 410 is also configured such that as the switch moves from an OFF position to an ON position, second movable contact 428 makes contact with one of second, third, or fourth contact pads 416, 418, 420 at the same time first movable contact 426 makes contact with first stationary contact pad 414. Consequently, arcing occurs with both the first and second movable contacts 426, 428. This configuration is capable decreasing formation of arcing erosion debris at the contact pads connected to the negative terminal as compared to the amount generated by configurations known in the prior art.

Figure 7:
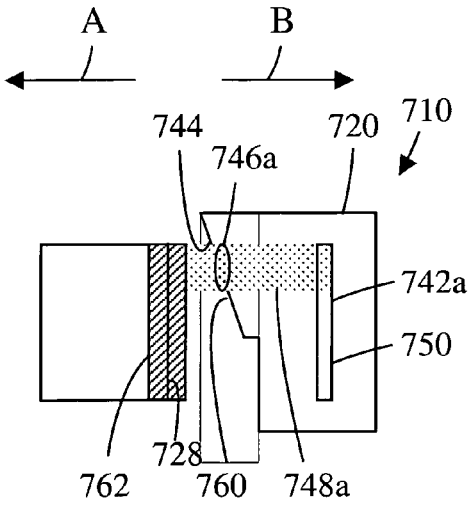
FIG. 7 is a plan view illustrating an aspect of an alternate embodiment of the present invention.

FIG. 7 depicts a first alternate contact pad configuration 710 of many possible configurations in accordance with the present invention where a stationary contact pad 720 and a movable contact 728 are mutually shaped and configured such that at least a portion 750 of a contacting zone 742*a* lies outside an arcing zone 746*a* when contacting zone 742*a* is projected along a path of movement of contact head 728 as depicted by arrows A and B. Therefore, a region 750 is provided within contacting zone 742*a* which is generally outside arcing erosion debris path 748*a* created by movable contact 728 as it slides across stationary contact pad 720. FIG. 7 illustrates a protruding portion 744*a*, a receiving edge 760, and a line of contact 762 of movable contact 728. The line of contact 762 and the receiving edge 760 are in nonparallel relation with respect to each other.

Figure 8:
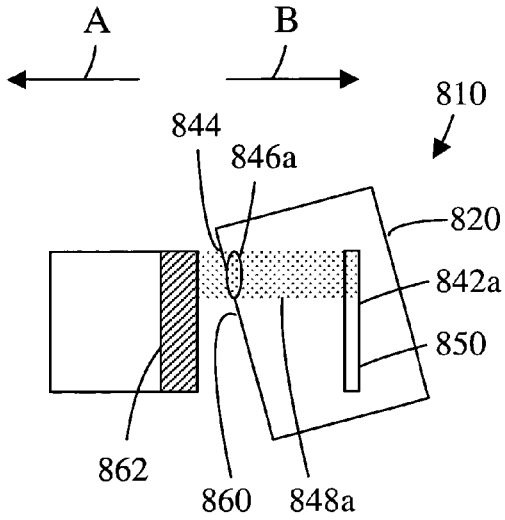
FIG. 8 is a plan view illustrating an aspect of a second alternate embodiment of the present invention.

FIG. 8 depicts a second alternate contact pad configuration 810 of many possible configurations in accordance with the present invention where a stationary contact pad 820 and a movable contact 828 are mutually shaped and configured such that at least a portion 850 of a contacting zone 842*a* lies outside an arcing zone 846*a* when contacting zone 842*a* is projected along a path of movement of contact head 828 as depicted by arrows A and B. Therefore, a region 850 is provided within contacting zone 842*a* which is generally outside arcing erosion debris path 848*a* created by movable contact 828 as it slides across stationary contact pad 820. A receiving edge 860 is shown in nonparallel relation to movable contact 862.

Figure 9:
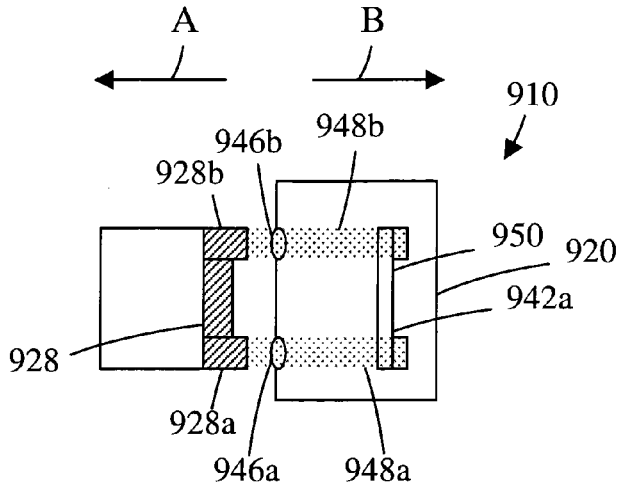
FIG. 9 is a plan view illustrating an aspect of a third alternate embodiment of the present invention.

FIG. 9 depicts a third alternate contact configuration 910 of many possible configurations in accordance with the present invention. A conventional stationary contact pad 920 is rectangular shaped and movable contact 928 has first and second projecting portions 928*a*, 928*b*. Stationary contact pad 920 and movable contact 928 are mutually shaped and configured such that at least a portion 950 a contacting zone 942*a* lies outside an arcing zone 946*a*, 946*b* when contacting zone 942*a* is projected along a path of movement of movable contact 928 as depicted by arrows A and B. Therefore, a region 950 is provided within contacting zone 942*a* which is generally outside arcing erosion debris path 948*a*, 948*b* created by movable contact 928 as it slides across stationary contact pad 920.

Figure 10:
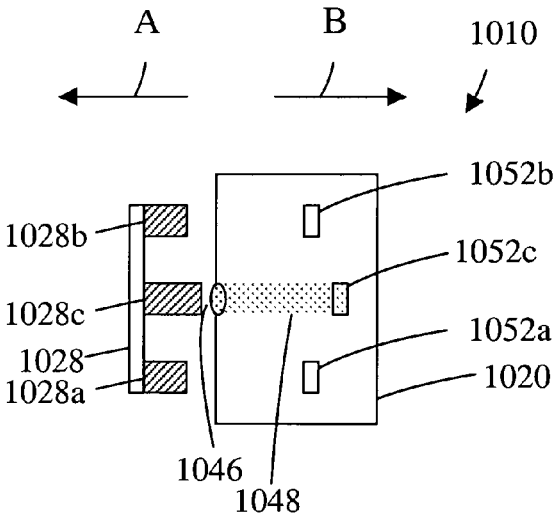
FIG. 10 is a plan view illustrating an aspect of a fourth alternate embodiment of the present invention.
Figure 11:
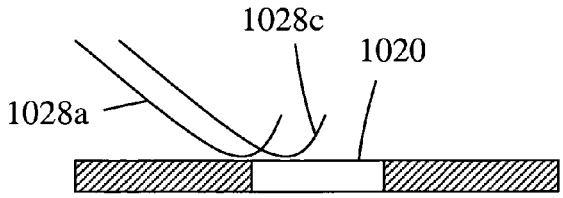
FIG. 11 is a section view of the an aspect of the fourth alternate embodiment of the present invention.
Figure 12:
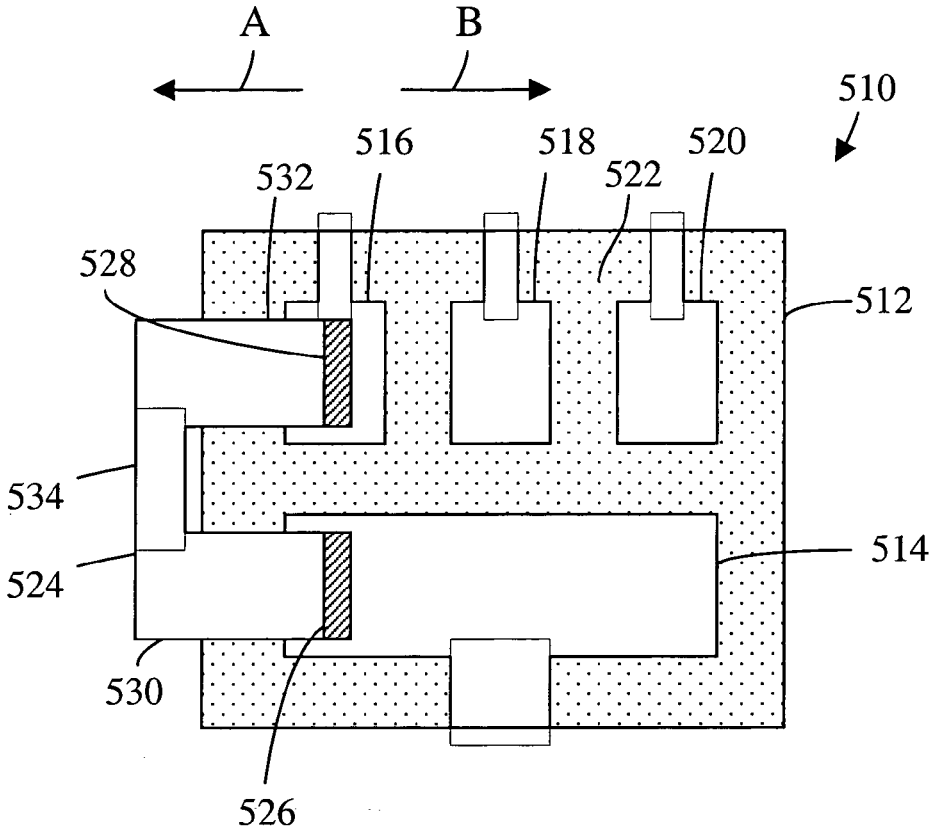
FIG. 12 is a plan view of a contact structure known in the prior art.
Figure 13:
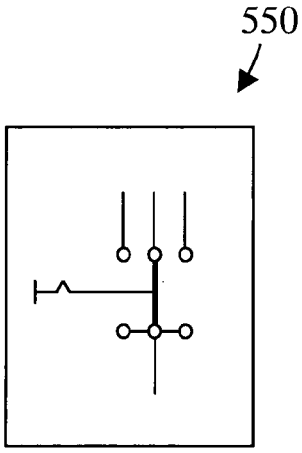
FIG. 13 is an electrical schematic of the contact structure shown on FIG. 12.
Figure 14:
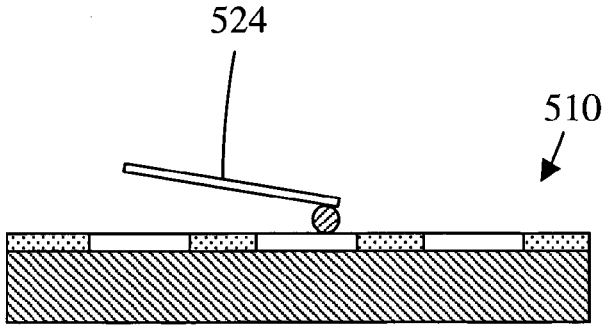
Fig. 14 Prior Art
FIG. 14 is a sectional view of a prior art contact structure.
Figure 15:
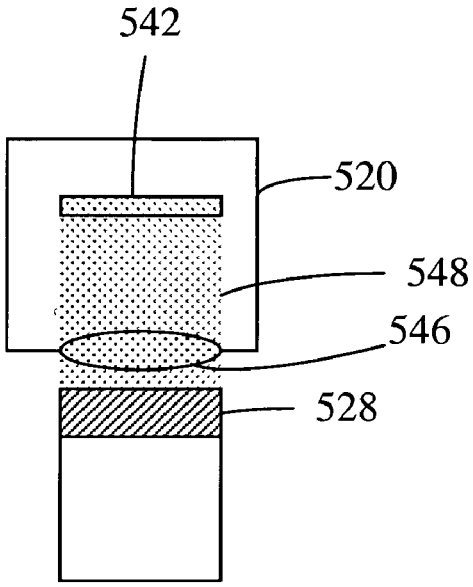
FIG. 15 is a plan view illustrating an aspect of a prior art contact structure.

FIGS. 10 and 11 depict a fourth alternate contact configuration 1010 of many possible configurations in accordance with the present invention. A stationary contact pad 1020 is rectangular shaped and movable contact 1028 includes first, second, and third furcations 1028*a,b,c*. Stationary contact pad 1020 and movable contact head 1028 are mutually shaped and configured such that at least a portion 1052*b,c* of contacting zone 1052*a,b,c* lies outside an arcing zone 1048 when contacting zone 1052*a,b,c* is projected along a path of movement of movable contact 1028 as depicted by arrows A and B.

The preferred embodiments shown and described herein are provided merely by way of example and are not intended to limit the scope of the invention in any way. Preferred dimensions, ratios, materials and construction techniques are illustrative only and are not necessarily required to practice the invention. It is intended that the scope of the present invention herein disclosed should not be limited by the particular disclosed embodiments herein. Further modifications and alterations may occur to others upon reading and understanding the specification.

Having thus described the invention, what is claimed is:

1. A contact structure for a sliding switch, comprising:

first and second conductive stationary contacts of a first potential disposed on a base;

a third conductive stationary contact of a second potential different from said first potential disposed on said base, said third stationary contact including first and second conductive regions; and a conductive movable contact for electrically contacting at least one of said stationary contacts, said movable contact being movable along a path between a non-contact position and a make contact position with respect to said at least one of said stationary contacts, said at least one of said stationary contacts having a protruding portion configured to provide an electrical interface for discharge of arcing as said movable contact moves between said make contact position and said non-contact position.

2. A contact structure for a sliding switch as recited in claim 1, wherein said at least one of said stationary contacts is a flat pad.

3. A contact structure for a sliding switch as recited in claim 1, wherein said movable contact is generally substantially shaped as a cylinder.

4. A contact structure for a sliding switch as recited in claim 3, wherein a central axis of said movable contact is perpendicular to said path.

5. A contact structure for a sliding switch, comprising:

first and second conductive stationary contacts of a first potential disposed on a base;

a third conductive stationary contact of a second potential different from said first potential disposed on said base, said third stationary contact including first and second conductive regions;

a conductive movable contact disposed to move relative to said first and second stationary contacts along a path extending from a non-contact position, in which said movable contact is electrically isolated from at least one of said stationary contacts to a make-contact position, in which said movable contact maintains a primary electrical interface with said at least one of said stationary contacts;

a contacting zone defined on said at least one of said stationary contacts that electrically contacts said movable contact when said movable contact is in said make-contact position; and an arcing zone defined on said at least one of said stationary contacts that terminates electrical contact with said movable contact when said movable contact moves from said make-contact position to said non-contact position or initiates electrical contact with said movable contact when said movable contact moves from said non-contact position to said make-contact position, said arcing zone providing an electrical interface where arcing occurs between said at least one of said stationary contacts and said movable contact, wherein said at least one of said stationary contacts and said movable contact are mutually shaped and oriented such that when said contacting zone is projected along said path onto said arcing zone, at least a portion of a projection of said contacting zone lies outside said arcing zone, thereby providing a region within said contacting zone which is generally outside of an arcing erosion debris path created by said movable contact as said movable contact moves along said path.

6. A method of preventing degradation in performance of a sliding switch comprising the steps of:

providing first and second conductive stationary contacts of a first potential disposed on a base;

providing a third conductive stationary contact of a second potential different from said first potential disposed on said base, said third stationary contact including first and second conductive regions;

providing a conductive movable contact for electrically contacting at least one of said stationary contacts, said movable contact being movable along a path between a non-contact position and a make contact position with respect to said at least one of said stationary contacts;

and causing arcing to occur outside said path upon engagement or disengagement between said conductive moveable contact and said at least one of said stationary contacts.

7. A method of preventing degradation in performance of a sliding switch comprising the steps of:

providing first and second conductive stationary contacts of a first potential disposed on a base;

providing a third conductive stationary contact of a second potential different from said first potential disposed on said base, said third stationary contact including first and second conductive regions;

providing a conductive movable contact for electrically contacting at least one of said stationary contacts, said movable contact being movable along a path between a make contact position and a non-contact position with respect to said at least one of said stationary contacts; and providing at least one protrusion on at least one of said contacts to provide an electrical interface for discharge of arcing as said movable contact breaks from said at least one of said stationary contacts, wherein said at least one protrusion is configured to direct said discharge of arcing away from at least a portion of said path.

8. A contact structure for a sliding switch, comprising:

first and second conductive stationary contacts of a first potential disposed on a base;

a third conductive stationary contact of a second potential different from said first potential disposed on said base, said third stationary contact including first and second conductive regions; and a conductive movable contact for electrically connecting said first and second stationary contacts, said movable contact being movable from a make contact position, in which said movable contact electrically connects said stationary contacts, to a non-contact position, in which said stationary contacts are electrically isolated from one another, said movable contact being configured to simultaneously terminate electrical contact with both of said first and second stationary contacts as said movable contact moves from said make contact position to said non-contact position.

9. A contact structure for a sliding switch, comprising:

first and second conductive stationary contacts of a first polarity disposed on a base;

a conductive third stationary contact of a second polarity opposite said first polarity disposed on said base, said third stationary contact including first and second conductive portions;

an insulator disposed so as to electrically isolate said first, second, and third stationary contacts and said first and second conductive portions of said third stationary contact; and a conductive movable contact configured to move along a path from a first contact position, in which said movable contact electrically connects said first stationary contact and said first portion of said third stationary contact, to a second contact position, in which said movable contact electrically connects said second stationary contact and said second portion of said third stationary contact, wherein said path includes a non-contact position located between said first and second contact positions, in which non-contact position said stationary contacts are electrically isolated from one another; and wherein said movable contact is configured to terminate electrical contact with said first portion of said third stationary contact before said movable contact terminates electrical contact with said first stationary contact as said movable contact moves from said first contact position toward said non-contact positions thereby directing discharge of arcing to said third stationary contact and preventing degradation of insulation performance between said first and second stationary contacts.

* * * * *